US011097878B2

(12) United States Patent
Dietrich

(10) Patent No.: US 11,097,878 B2
(45) Date of Patent: Aug. 24, 2021

(54) FLEXIBLE CONNECTOR

(71) Applicant: Rolf Dietrich, Toledo, OH (US)

(72) Inventor: Rolf Dietrich, Toledo, OH (US)

( * ) Notice: Subject to any disclaimer, the term of this patent is extended or adjusted under 35 U.S.C. 154(b) by 153 days.

(21) Appl. No.: 15/670,652

(22) Filed: Aug. 7, 2017

(65) Prior Publication Data

US 2017/0334621 A1 Nov. 23, 2017

Related U.S. Application Data

(63) Continuation of application No. 14/121,143, filed on Aug. 5, 2014, now Pat. No. 9,725,220.

(60) Provisional application No. 61/958,759, filed on Aug. 5, 2013.

(51) Int. Cl.
*B65D 65/10* (2006.01)
*B65D 63/10* (2006.01)

(52) U.S. Cl.
CPC ..... *B65D 63/10* (2013.01); *B65D 63/1018* (2013.01); *B65D 63/1027* (2013.01); *Y10T 24/1498* (2015.01)

(58) Field of Classification Search
CPC ..... B65D 63/10; B65D 63/1018; B65D 63/1027; B65D 63/00; B65D 2313/02; Y10T 24/1498; Y10T 24/1406; Y10T 24/141; Y10T 24/1418; Y10T 24/142; Y10T 24/1422; Y10T 403/7001; Y10T 29/4987; Y10T 29/46796; Y10T 24/45215; Y10T 24/14; Y10T 24/27; Y10T 24/2708; A44B 18/0088; Y02W 30/80
USPC ..... 24/16 PB
See application file for complete search history.

(56) References Cited

U.S. PATENT DOCUMENTS 5,048,158 A * 9/1991 Koerner ..... A44B 18/00 24/16 PB
5,168,603 A * 12/1992 Reed ..... A44B 18/00 24/16 R
5,802,676 A * 9/1998 Tolan ..... A44B 18/00 24/16 PB
6,317,933 B1 * 11/2001 Suenaga ..... A44B 18/0088 24/16 R
2003/0110596 A1 * 6/2003 Graham ..... B65D 63/1018 24/16 R

* cited by examiner

*Primary Examiner* — Jack W Lavinder
(74) *Attorney, Agent, or Firm* — Charles F. Charpie, III

(57) ABSTRACT

A flexible strap connector is disclosed. The connector comprises a strap having a buckle head at one end and a tongue at the opposite end. Ratchet teeth extend on one side of the strap and the ratchet teeth cooperate with the buckle head to permit movement of the strap in a first direction and to prevent movement of the strap in a second direction. A second slot is formed in the strap itself and it is a non-locking slot. When the strap is in the second slot, the strap is free to move further into the slot and free to be withdrawn from the slot. Embodiments where the buckle head and ratchet teeth are replaced with hook and loop fasteners are also disclosed.

8 Claims, 23 Drawing Sheets

FLEXIBLE CONNECTOR

BACKGROUND OF THE INVENTION

1. Field of the Invention

This invention concerns the fields of flexible polymeric connectors and fasteners of a type generally referred to as zip ties or cable ties, and textile flexible textile connectors and fasteners.

2. Background of the Invention

In a prior art search directed to the subject invention, the following U.S. patents and Published U.S. patent applications were noted: 20110131768, 20030088948, U.S. Pat. Nos. 7,926,767, 7,789,414, 7,131,168, 6,698,067, 6,539,589, 6,507,979 6,364,257, 6,332,248, 6,330,989, 6,151,761, 5,581,850, 5,568,905, 5,395,343, 4,466,159, 4,191,334, 3,981,048, 3,739,429, 3,654,669, 3,224,056, 2,977,145, D634187, D256438, and D205659.

BRIEF SUMMARY OF THE INVENTION

The present invention is a flexible connector which is especially useful for connecting two or more objects together. The flexible connector comprises a flexible strap with two ends, two opposed broad sides and two opposed edges.

In one example of the invention, at one end of the flexible strap, there is a buckle head and at the opposite end of the strap there is a tongue. A set of ratchet teeth extends along at least one of the broad sides. A first slot is provided in the buckle head and it is a locking slot. When the strap is in the first slot, the ratchet teeth cooperate with the buckle head to permit movement of the strap in a first direction and they cooperate to prevent movement of the strap in a second direction. A second slot is formed in the strap itself and it is a non-locking slot. When the strap is in the second slot, the strap is free to move further into the slot and free to be withdrawn from the slot.

To use the connector to connect a first object to a second object, the strap tongue is inserted into the second, non-locking slot to form a first loop which encircles a portion of the first object. The strap tongue is then inserted into the first locking slot to form a second loop which encircles a portion of the second object. Tension applied to the tongue cinches the first loop causing it to get smaller so that the first loop tightens around the first object. Tension applied to the strap tongue also cinches the second loop causing it to get smaller so that the second loop tightens around the second object. When the first loop and the second loop are cinched tightly around the first and second objects, respectively, the connector connects the first and second objects. Cooperation between the ratchet teeth and the locking slot prevents the first and second loops from getting larger. Thus, the first and second objects remain connected.

The connector according to the first example may be configured so that, when two objects are connected by the connector with portions of the strap in the first and second slots, no portion of either one of the two opposed edges is in contact with any other portion of either one of the two opposed edges. Ratchet teeth may be provided on one of the broad sides and the opposed broad side may be smooth. When two objects are connected by the connector, it may be preferred that the smooth surface be in contact with one of the objects. If three objects are connected by the connector, the smooth surface may be in contact with two of the objects. If X objects are connected by the connector, the smooth surface may be in contact with X minus 1 of the objects.

In another example of the invention, at one end of the flexible strap, there is a hook or loop fastener and at the opposite end of the strap there is a mating hook or loop fastener. Hook and loop fastener is used herein in its broadest sense to mean a fastening system comprising a hook-type material and a loop-type material which, when they are pressed together, engage each other and resist being separated. A slot is formed in the strap itself and it is a non-locking slot. When the strap is in the slot, the strap is free to move further into the slot and free to be withdrawn from the slot.

To use this connector to connect a first object to a second object, the strap is inserted into the non-locking slot to form a first loop which encircles a portion of the first object. The free end of the strap is then wrapped around a portion of the second object to form a second loop. Tension applied to the free end of the strap cinches the first loop causing it to get smaller so that the first loop tightens around the first object. The first and second ends are then wrapped around the second object and pulled together to form a second loop. When the second loop is tight around the second object, the hook or loop faster at one end of the strap is pressed against the mating hook or loop fastener at the opposite end of the strap to hold the loops tight so that the connector connects the first and second objects. Engagement between the hook and loop fasteners prevents the first and second loops from getting larger. Thus, the first and second objects remain connected.

Many objects and advantages of a connector according to the invention will be understood by persons skilled in the art who study the following description and the accompanying drawings which, although thorough, are merely illustrative of the connector.

DETAILED DESCRIPTION OF THE INVENTION

Figure 3:
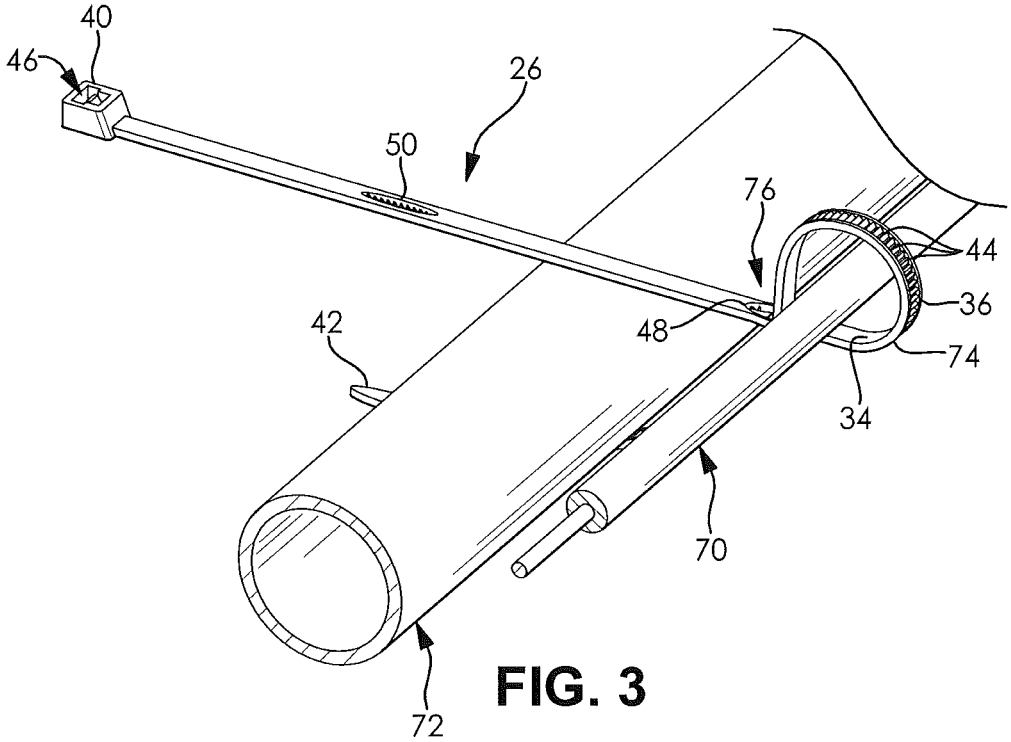
FIG. 3 is a perspective view showing a step in a method for using the connector to connect two objects.
Figure 11:
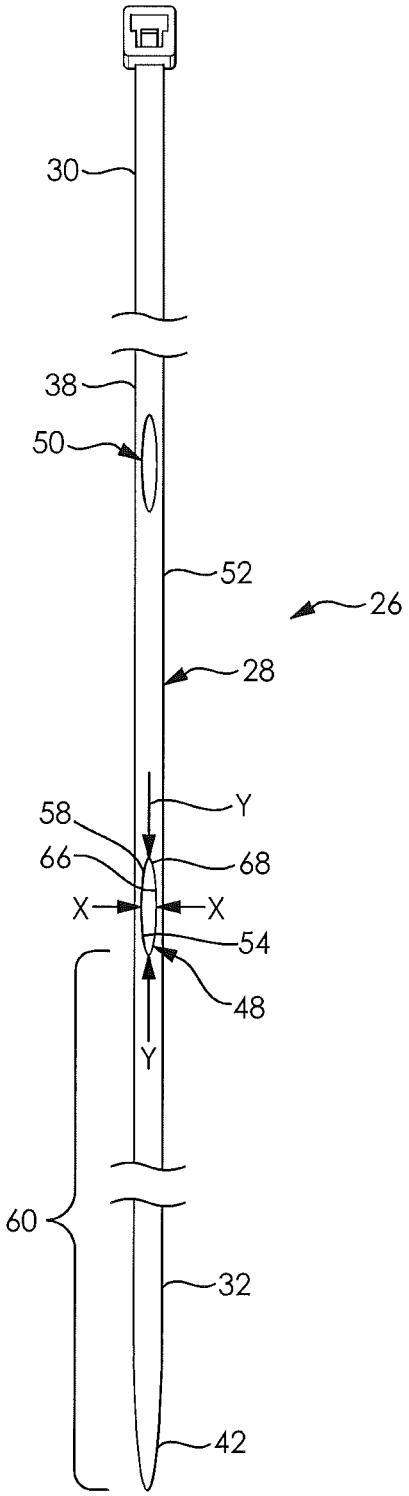
FIG. 11 is a plan view of the connector shown is FIG. 2.
Figure 12:
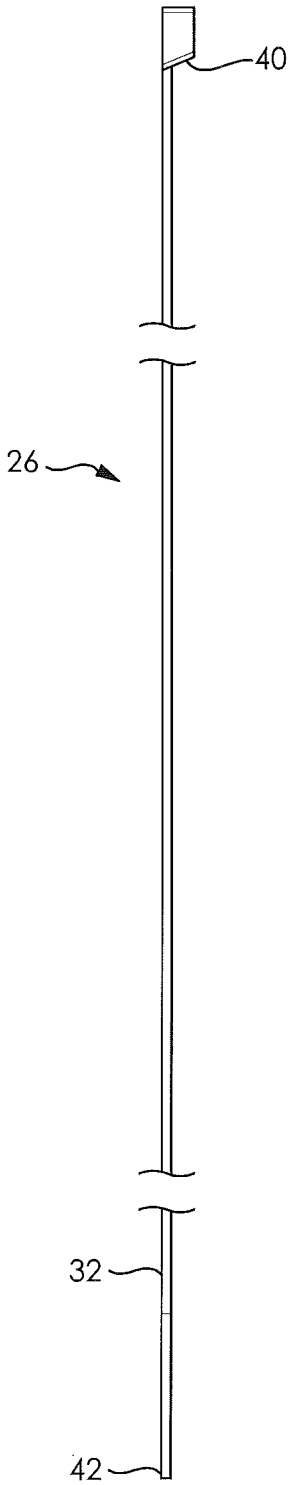
FIG. 12 is a side view of the connector shown is FIG. 2.
Figure 27:
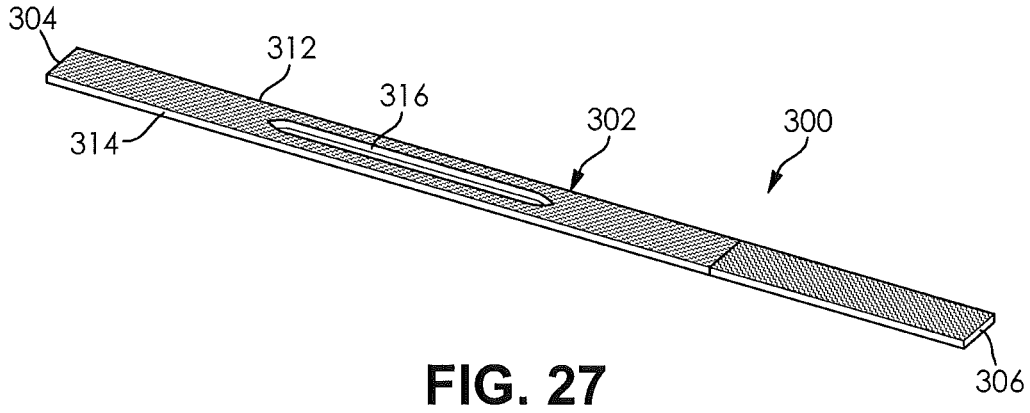
FIG. 27 is a perspective view of another example of a connector embodying the invention.

A flexible connector according to another example of the invention is indicated generally at 300 in FIG. 27. The flexible connector 300 comprises a flexible strap 28 with first and second ends 30 and 32, a first broad side 34 and a second opposed broad side 36 (FIG. 3), a first edge 38 and a second opposed edge 52 (FIG. 11). Attached to the first end 30 of the strap 28 is a buckle head 40. Attached to the second end 32 of the strap 28 is a tongue 42. A set of ratchet teeth, some of which are indicated at 44 in FIG. 3, are provided on the second broad side 36. The ratchet teeth 44 extend laterally across the broad side 36 of the strap 28.

A first slot indicated at 46 is provided and it extends through the buckle head 40. The first slot 46 is a locking slot. When the strap 28 is in the first slot 46, the ratchet teeth 44 engage a pawl (visible in FIGS. 7-10) in the buckle head 40 to permit movement of the strap 28 in a first direction—into the slot 46—and the ratchet teeth 44 cooperate with the pawl to prevent movement of the strap 28 in a second direction—out of the slot 46. This locking slot arrangement is known. In this conventional locking slot, the ratchet teeth 44 engage the pawl when the tongue 42 is inserted into the buckle head slot 46 from one direction but not when the tongue 42 is inserted into the buckle head slot 46 from the other direction. In any case, slot 46 is referred to as a locking slot. This and other locking slot arrangements are suitable for use in a connector according to the invention.

A second slot indicated at 48 is formed in the strap 28 and extends through the strap 28 from the first broad side 34 to the second broad side 36. A third slot indicated at 50 is formed in the strap 28 and extends through the strap 28 from the first broad side 34 to the second broad side 36. The slots 48 and 50 are non-locking slots. When the strap 28 is in the second slot 48 and/or the third slot 50, the strap 28 is free to move further into the slot(s) and is free to be withdrawn from the slot(s).

The slot 48 and the slot 50 extend longitudinally along the strap 28 and are positioned between the buckle head 40 and the tongue 42. The slot 48 has a lateral dimension of X-X (FIG. 11) and a longitudinal dimension of Y-Y. The longitudinal dimension is greater than the lateral dimension. The first edge 38 of the strap 28 and an opposed edge 52 of the strap 28 extend longitudinally and they are substantially parallel along their lengths and, in particular, substantially parallel adjacent to the slot 48. The distance between the edge 38 and the edge 52 defines the width of the strap 28. The slot is defined, in part, by a first edge 54 adjacent to the edge 38 of the strap 28. The slot is also defined, in part, by an edge 56 adjacent to the edge 52 of the strap 28. There is a first bridge 58 between the strap edge 38 and the edge 54. The bridge 58 connects a first strap portion 60 to a second strap portion 62. The strap portion 60 is the portion of the strap 28 between the second end 32 of the strap 28 and the slot 48. The strap portion 62 is the portion of the strap 28 between the slot 48 and the slot 50. There is a second bridge 64 between the strap edge 52 and the edge 56. The bridge 64 also connects the first strap portion 60 to the second strap portion 62.

The slot 48 extends longitudinally from a first end 66 to a second end 68. The distance between slot ends 66 and 68 define the length of the slot 48. In this case, the length of the slot 48 is greater than the width of the strap 28.

FIGS. 3 through 9 illustrate a series of steps for connecting a first article 70 to a second article 72 with the connector 26. In these Figures, the first article 70 is a sheathed cable and the second article 72 is a hollow frame member. The articles 70 and 72 happen to be round in cross section although it will be appreciated by now that the connector 26 is so versatile that it is suited for connecting an article of any shape, size and cross-sectional shape to any other article.

Figure 4:
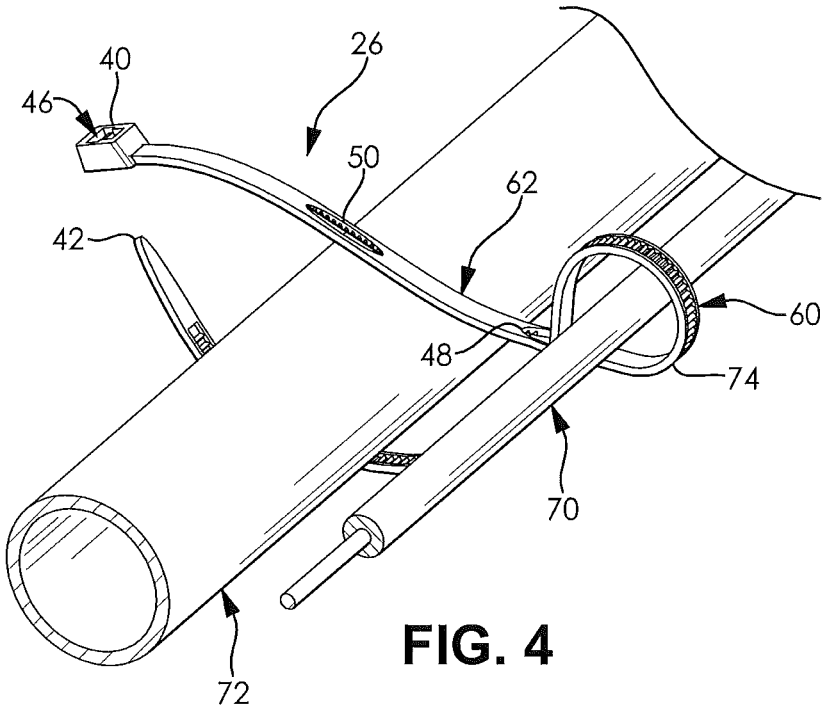
FIG. 4 is a perspective view showing another step in a method for using the connector to connect two objects.
Figure 5:
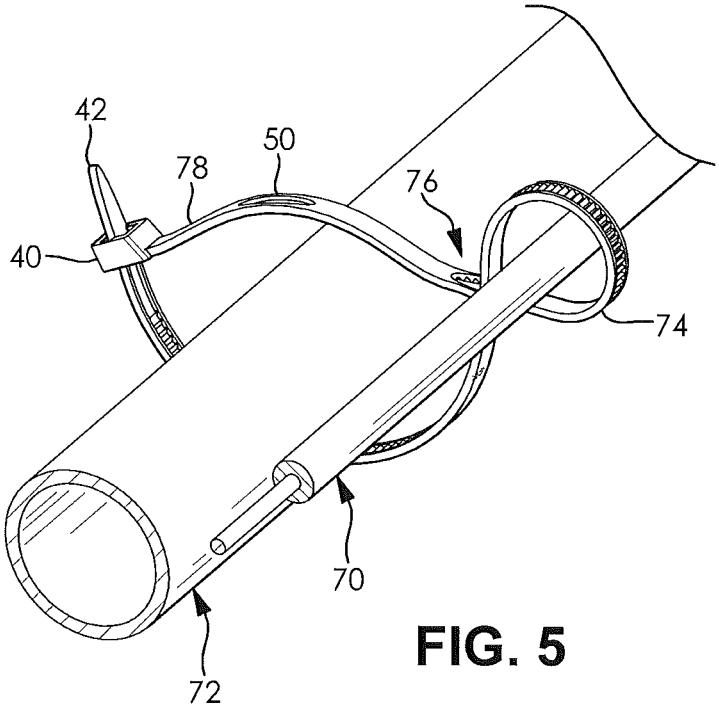
FIG. 5 is a perspective view showing another step in a method for using the connector to connect two objects.
Figure 6:
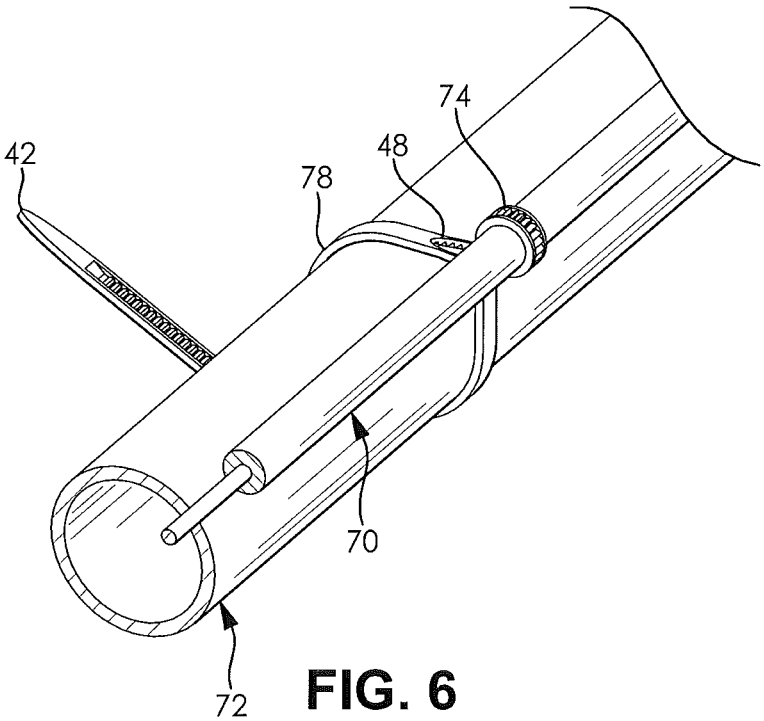
FIG. 6 is a perspective view showing another step in a method for using the connector to connect two objects.
Figure 7:
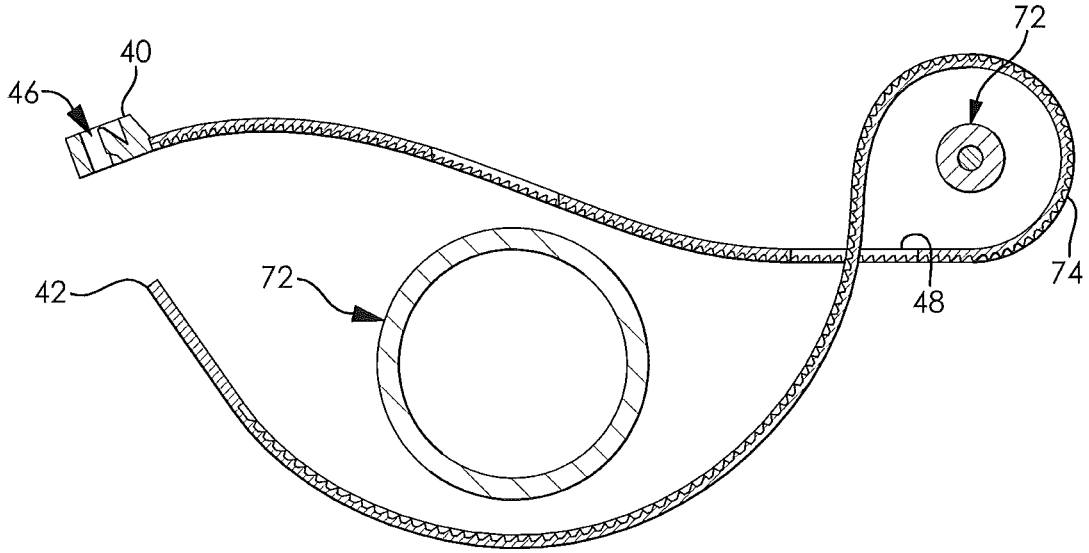
FIG. 7 is a cross sectional view showing a step in a method for using the connector to connect two objects.
Figure 8:
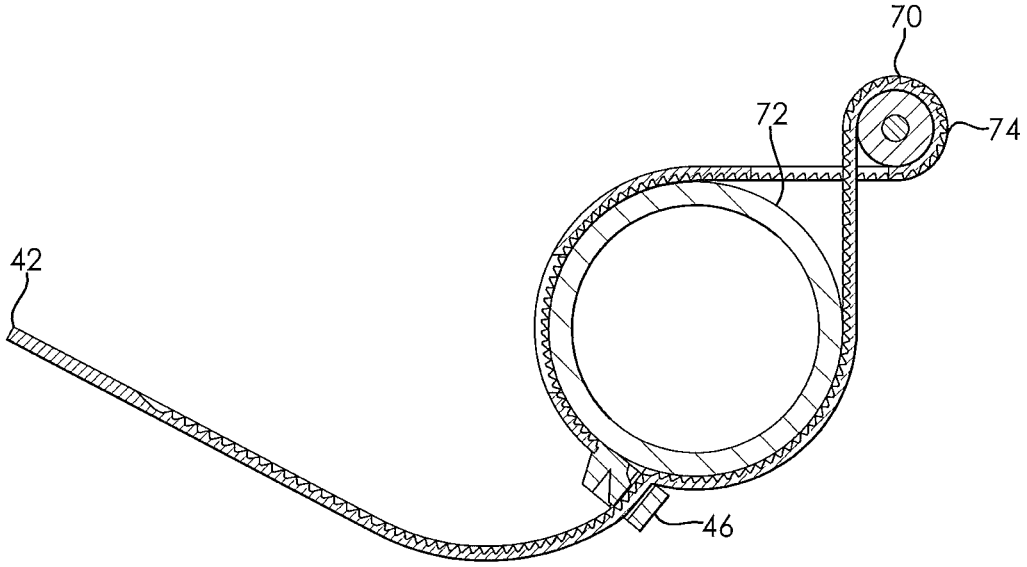
FIG. 8 is a cross sectional view showing another step in a method for using the connector to connect two objects.
Figure 9:
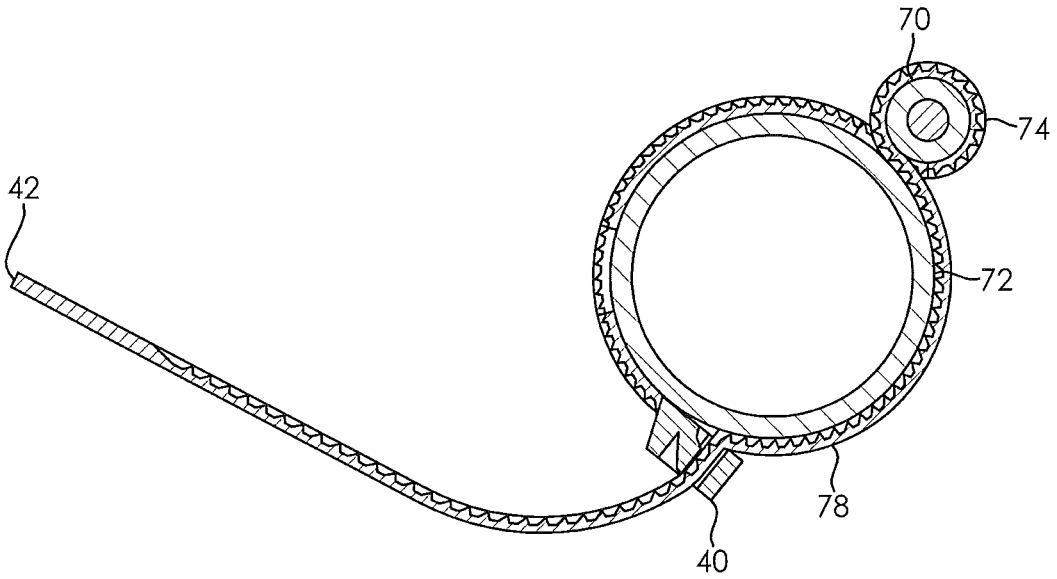
FIG. 9 is a cross sectional view showing two objects connected by the connector.

FIG. 3 illustrates the condition of the connector 26 and the articles 70 and 72 after the flexible strap 28 has been positioned around the first article 72 and the tongue 42 has been inserted into the slot 48. A first loop 74 is formed around the cable 70 by the first portion 60 of the flexible strap 28. An intersection 76 is formed at the slot 48 where the flexible strap 28 intersects itself. The first broad side 34 of the strap 28 faces inwardly towards the article 70 and the second broad side 36 of the strap 28 faces outwardly so that the ratchet teeth 44 do not contact the article 70. From the condition illustrated in FIG. 3, the flexible strap 28 is manipulated to move the tongue 42 towards the locking slot 46 in the buckle head 40 as seen in FIGS. 4 and 7. The first portion 60 of the flexible strap 28 is positioned on one side of the article 72 and the second portion 62 of the flexible strap 28 is positioned on the other side of the article 72 so that, when the tongue 42 is inserted into the locking slot 46 in the buckle head 40, as seen in FIG. 5, a second loop 78 is formed encircling the second article 72. The flexible strap 28 is pulled into the buckle head slot 46 and the ratchet teeth 44 engage the pawl inside that slot locking the strap 28 and preventing its withdrawal. As the flexible strap 28 is pulled further into the buckle head slot 46, the loops 74 and 78 are cinched causing them to tighten around the first and second objects 70 and 72, respectively. This condition is illustrated in FIGS. 6 and 8. It is to be noted that, at the intersection 76, the portions of the flexible strap 28 that intersect are substantially perpendicular. The first loop encircles the cable 70 but is only in contact with approximately three fourths or 270° of the circumference of the cable 70. However, as shown in FIG. 9, when the loops 74 and 78 are cinched to the limit, the loop 74 completely encircles the sheathed cable 70 so that the compressive forces exerted by the loop 74 on the cable 70 are distributed evenly around the circumference of the cable 70. So, too, the second loop 78 encircles the frame 72 so that compressive forces exerted by the loop 78 on the frame 72 are distributed evenly around the circumference of the frame 72. Thus, the strap 26 maximizes the area of contact between the flexible strap 28 and the first and second articles 70 and 72. In FIG. 9, it is shown that the distance between the first and second articles 70 and 72 is equal to the thickness of the flexible strap 28. The articles 70 and 72 are separated by the flexible strap so that contact and chafing between them are prevented.

Figure 10:
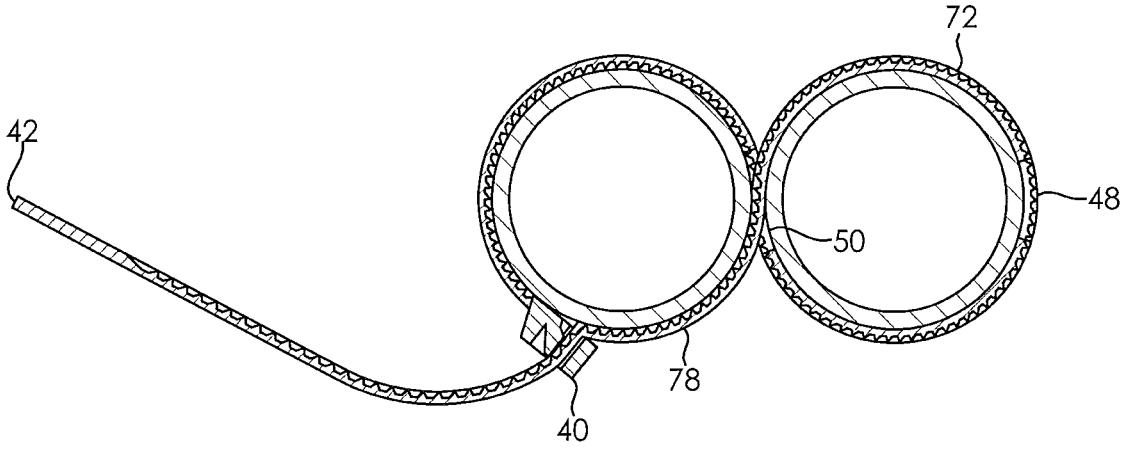
FIG. 10 is a cross sectional view showing two similarly sized objects connected by the connector.

FIG. 10 illustrates the use of the connector 26 to connect two articles 80 and 82 with similar diameters. For example, articles 80 and 82 might be hollow frame members as shown in FIG. 10. In this case, the tongue 42 has been inserted through the slot 50 and the connector 26 easily accommodates this case where neither member has a small diameter compared to the diameter of the other.

Figure 13:
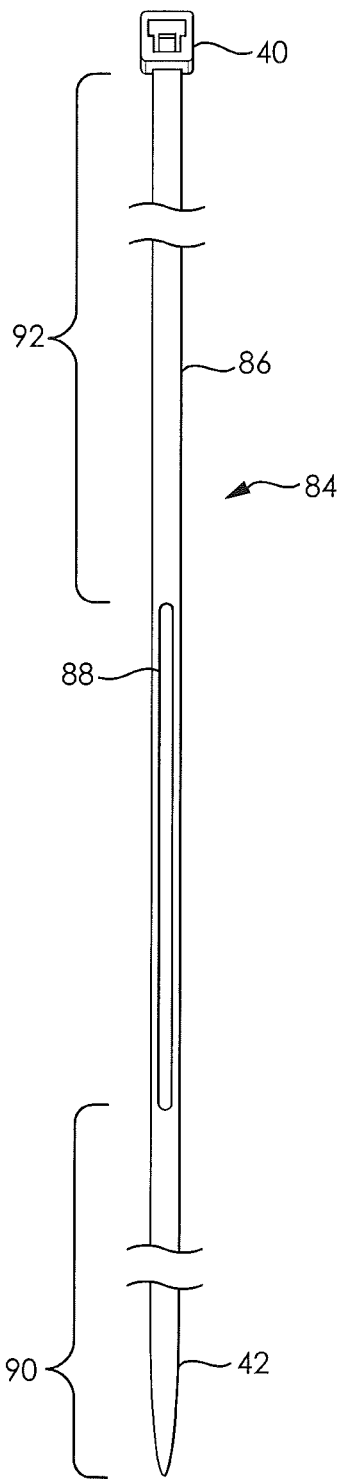
FIG. 13 is a plan view of another example of a connector according to the invention.
Figure 14:
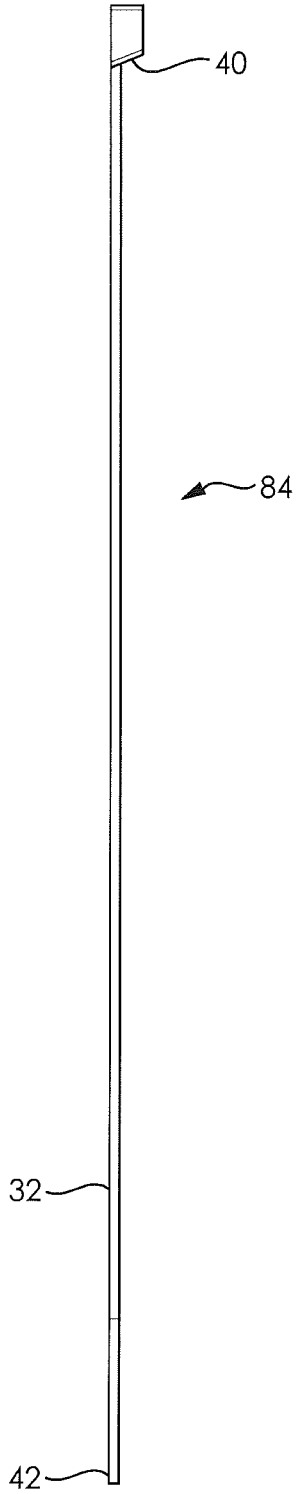
FIG. 14 is a side view of the connector shown in FIG. 13.
Figure 15:
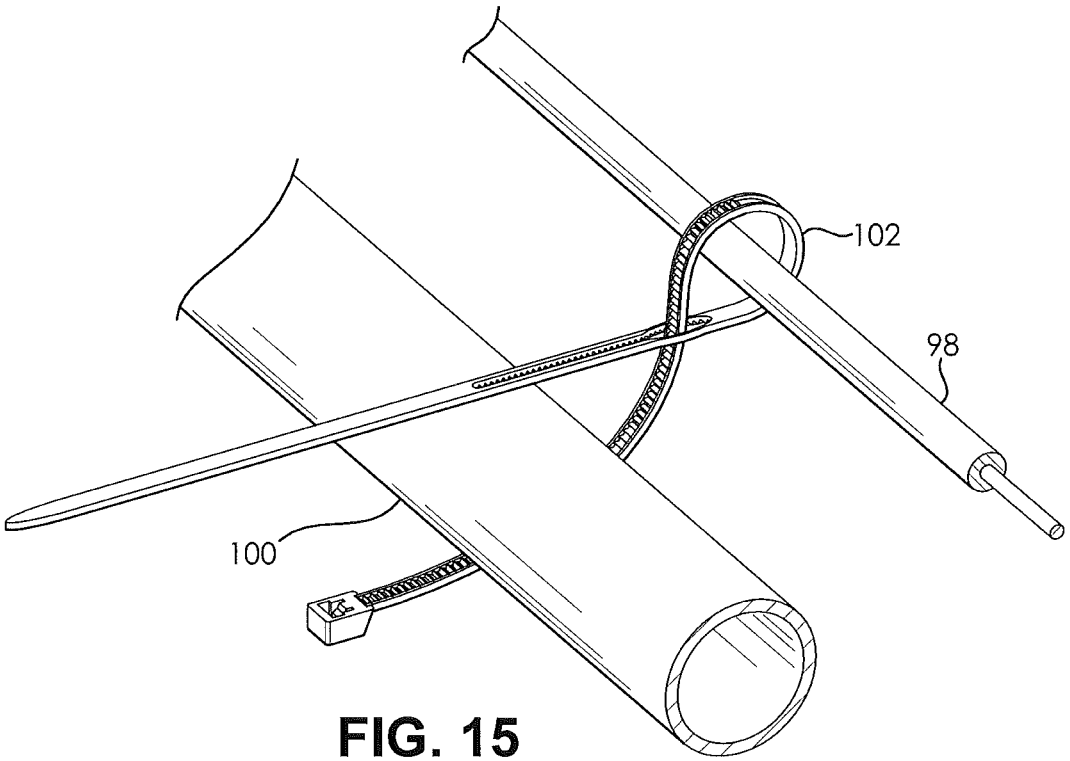
FIG. 15 is a perspective view showing a step in a method for using the connector shown in FIG. 13 to connect two objects.
Figure 16:
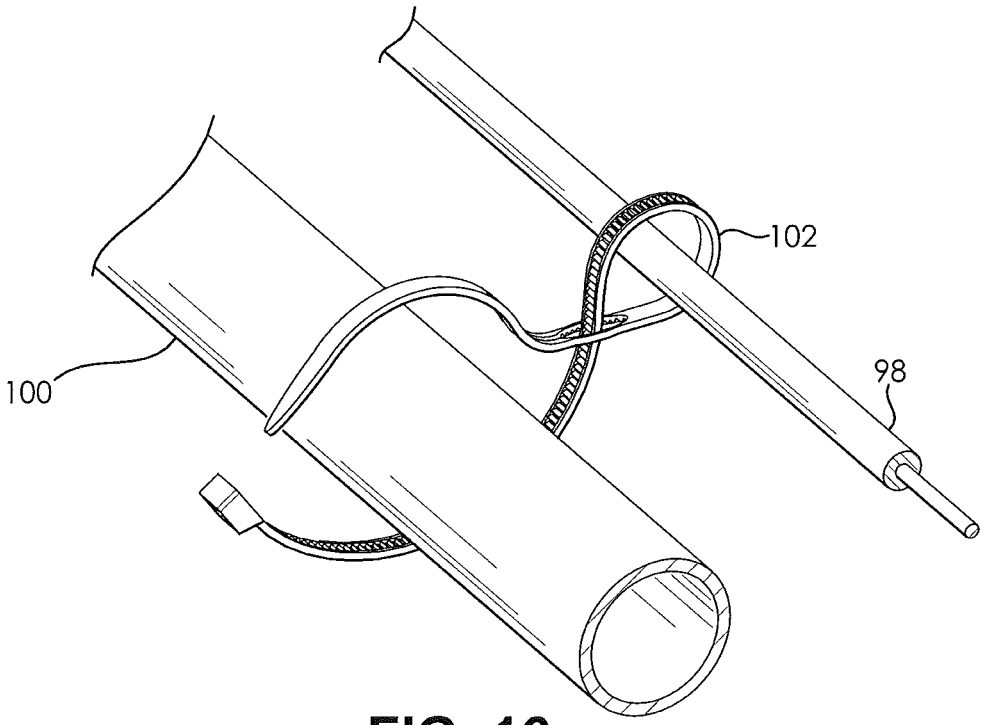
FIG. 16 is a perspective view showing another step in a method for using the connector shown in FIG. 13 to connect two objects.
Figure 17:
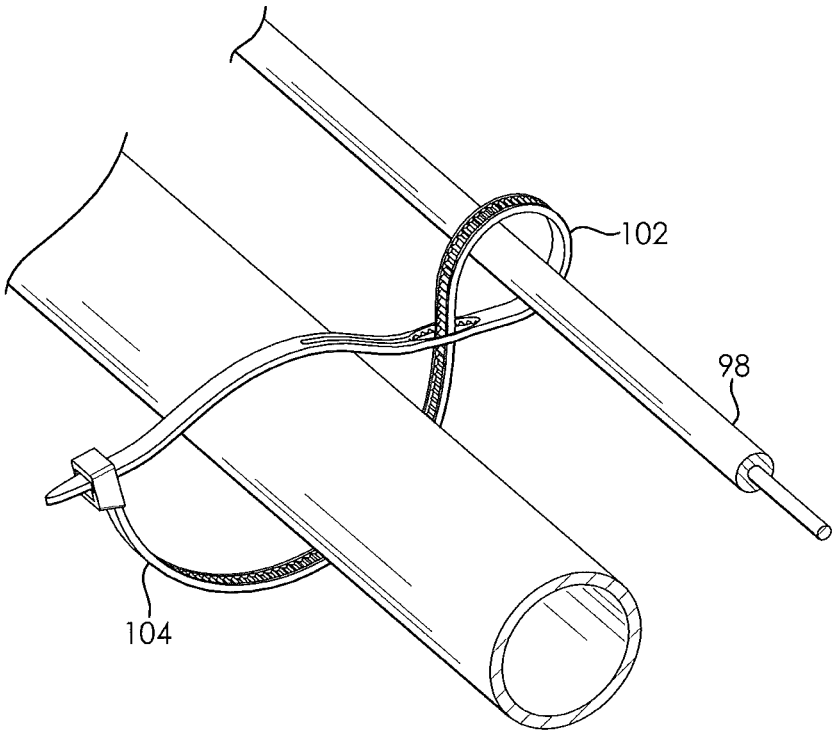
FIG. 17 is a perspective view showing another step in a method for using the connector shown in FIG. 13 to connect two objects.
Figure 18:
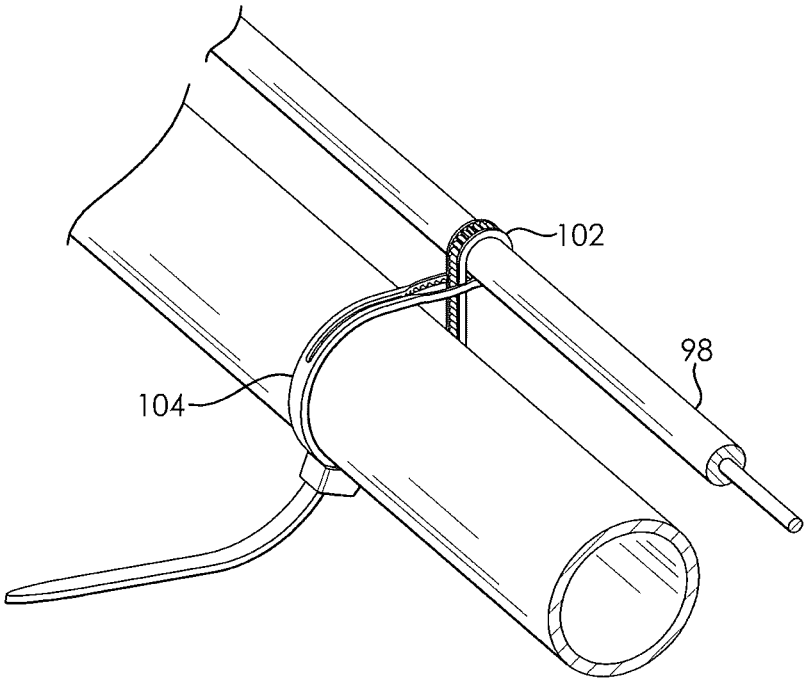
FIG. 18 is a perspective view showing another step in a method for using the connector shown in FIG. 13 to connect two objects.

A second example of a connector according to the invention is indicated generally at 84 in FIGS. 13 and 14. The connector 84 has a flexible strap 86 with a single slot 88 between two strap portions 90 and 92. The strap portion 90 extends between the slot 88 and a tongue 94. Strap portion 92 extends between the slot 88 and a buckle head 96. The connector 84 may be used to connect first and second objects in the manner described above with references to FIGS. 3 through 10. Alternatively, the connector 84 may be used to connect first and second members 98 and 100 in the manner shown in FIGS. 15 through 18. The connector 84 may be used by encircling a first member 98 with the connector 84 and inserting the buckle head 96 through the slot 88 to form a first loop 102 around the first member 98 (FIG. 15), manipulating the tongue 94 towards the buckle head 96 (FIG. 16), encircling the second member 100 and inserting the tongue 94 into the buckle head 96 to form a second loop 104 (FIG. 17) and tightening the connector 84 to cinch the loops 102 and 104 around the first and second members 98 and 100 (FIG. 18). The connector may be tightened further to draw the first and second members 98 and 100 closer together until they are separated by a distance equal to the thickness of the strap 86 (not shown separately).

Figure 19:
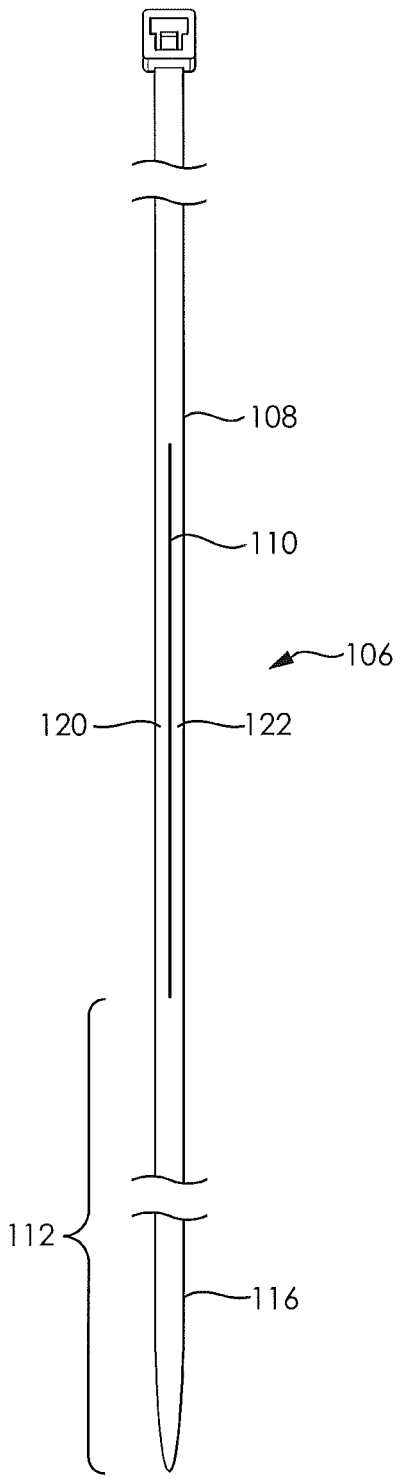
FIG. 19 is a plan view of another example of a connector according to the invention.
Figure 20:
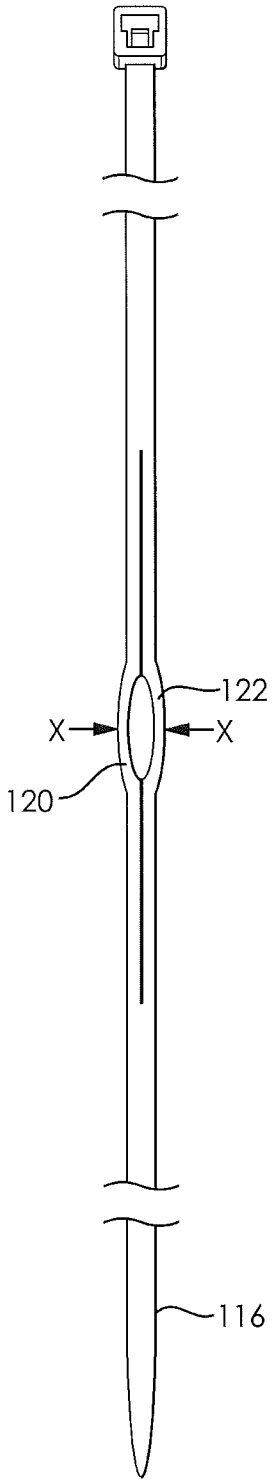
FIG. 20 is a plan view of the connector shown in FIG. 19.

A third example of a connector according to the invention is indicated generally at 106 in FIG. 19. The connector 106 has a flexible strap 108 with a single slot 110 between two strap portions 112 and 114. The strap portion 112 extends between the slot 110 and a tongue 116. Strap portion 114 extends between the slot 110 and a buckle head 118. In this case, there are two bridges 120 and 122. The combined width of the bridges 120 and 122 is equal to the width of the flexible strap 108 in the vicinity of the slot 110. The width of the slot 110 is zero when the connector 106 is not in use. Thus, the slot 110 is defined by a slit in the strap 108. When the tongue 116 is inserted into the slot 110, the bridges 120 and 122 begin to spread apart to accommodate the tongue 116. The bridges 120 and 122 separate further until the flexible strap 108 is between the bridges 120 and 122. This spacing is shown in FIG. 20 where the dimension X-X is equal to the combined width of the bridges 120 and 122 plus the width of the strap 108. When the connector 106 is used to connect first and second objects in the manner described above with references to FIGS. 3 through 10 and 15 through 18, the objects will be separated by a distance equal to the thickness of the strap 108.

Figure 21:
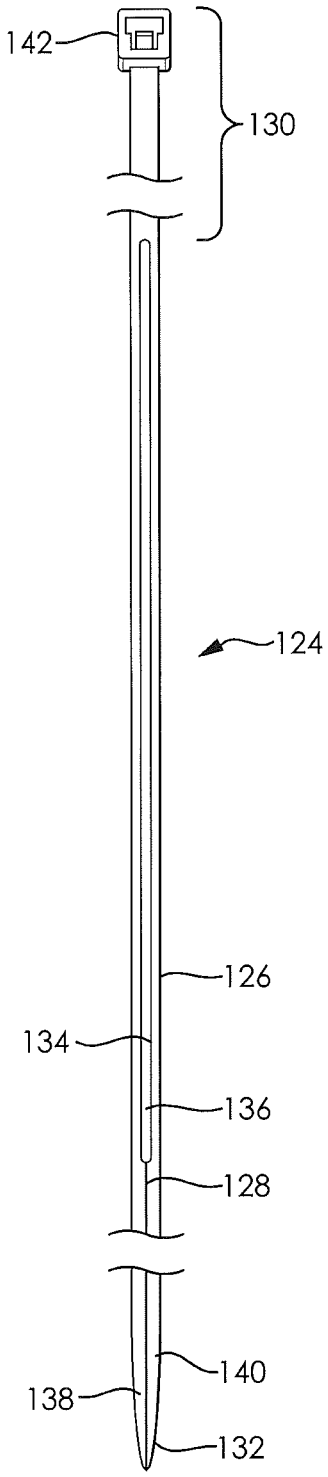
FIG. 21 is a plan view of another example of a connector according to the invention.

A fourth example of a connector according to the invention is indicated generally at 124 in FIG. 21. The connector 124 has a flexible strap 126 with a single slot 128 that extends from a first strap portion 130 all the way to and through a tongue 132. The slot 128 is a slit that divides the flexible strap into first and second strap segments 134 and 136 and divides the tongue 132 into first and second tongue segments 138 and 140. The first strap portion 130 extends between the slot 128 and a buckle head 142. In this example, the connector 124 can be used in the manner described above with references to Figures to FIGS. 3 through 10 and 15 through 18 by treating the tongue segments 138 and 140 as one of the tongues 42, 94 or 116. When the connector 126 is used to connect first and second objects in the manner described above with references to FIGS. 3 through 10 and 15 through 18, the objects will be separated by a distance equal to the thickness of the strap 126.

Figure 22:
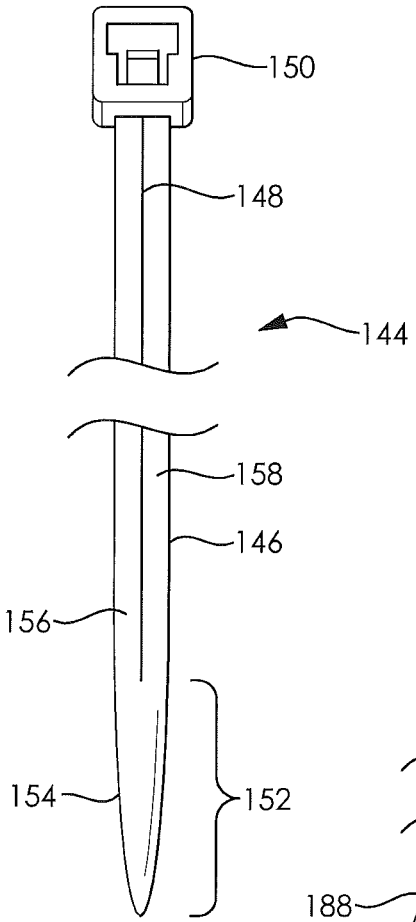
FIG. 22 is a plan view of another example of a connector according to the invention.

A fifth example of a connector according to the invention is indicated generally at 144 in FIG. 22. The connector 144 has a flexible strap 146 with a single slot 148 that extends from a buckle head 150 to a first strap segment 152. The first segment 152 extends between the slot 148 and a tip of a tongue 154. In this case, there are two bridges 156 and 158. The combined width of the bridges 156 and 158 is equal to the width of the flexible strap 146 in the vicinity of the slot 148 when the connector 144 is not in use. The width of the slot 148 is zero. When the tongue 154 is inserted into the slot 148, the bridges 156 and 158 begin to spread apart to accommodate the tongue 154. The bridges 156 and 158 separate further until the flexible strap 146 is between the bridges 156 and 158. When the connector 144 is used to connect first and second objects in the manner described above with references to FIGS. 3 through 10 and 15 through 18, the objects will be separated by a distance equal to the thickness of the strap 146.

Figure 23:
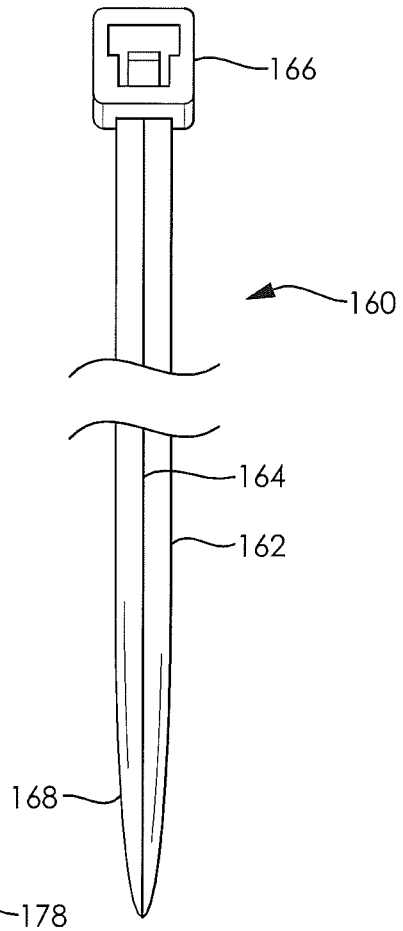
FIG. 23 is a plan view of another example of a connector according to the invention.

A sixth example of a connector according to the invention is indicated generally at 160 in FIG. 23. The connector 160 has a flexible strap 162 with a single slot 164 that extends from a buckle head 166 all the way to and through a tongue 168. The slot divides the flexible strap 162 into first and second strap segments 170 and 172 and divides the tongue 168 into first and second tongue segments 174 and 176. In this example, the connector 160 can be used in the manner described above with references to Figures to FIGS. 3 through 10 and 15 through 18 by treating the tongue segments 174 and 176 as one of the tongues 42, 94, 116 or 154. When the connector 160 is used to connect first and second objects in the manner described above with references to FIGS. 3 through 10 and 15 through 18, the objects will be separated by a distance equal to the thickness of the strap 162.

Figure 24:
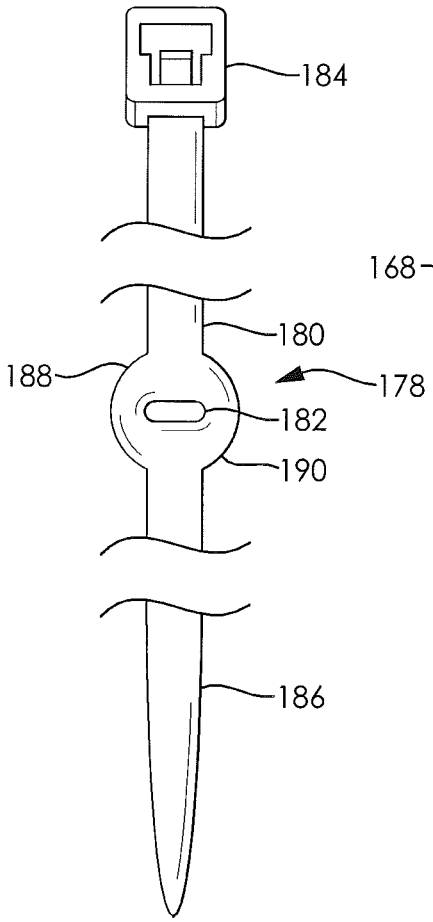
FIG. 24 is a plan view of another example of a connector according to the invention.

A seventh example of a connector according to the invention is indicated generally at 178 in FIG. 24. The connector 178 has a flexible strap 180 with a single slot 182 that is located between a buckle head 184 and a tip of a tongue 186. The slot 182 extends transversely or laterally in the strap 180. In this case, there are two bridges 188 and 190. The combined width of the bridges 188 and 158 can be approximately equal to the width of the flexible strap 180 so as to maintain the tensile strength of the strap 180 in the vicinity of the slot 182 although other widths may be utilized. The length of the slot 182 is approximately equal to the width of the strap 180, or greater. When the connector 178 is used to connect first and second objects in the manner described above with references to FIGS. 3 through 10 and 15 through 18, the objects will be separated by a distance equal to twice the thickness of the strap 180.

Figure 25:
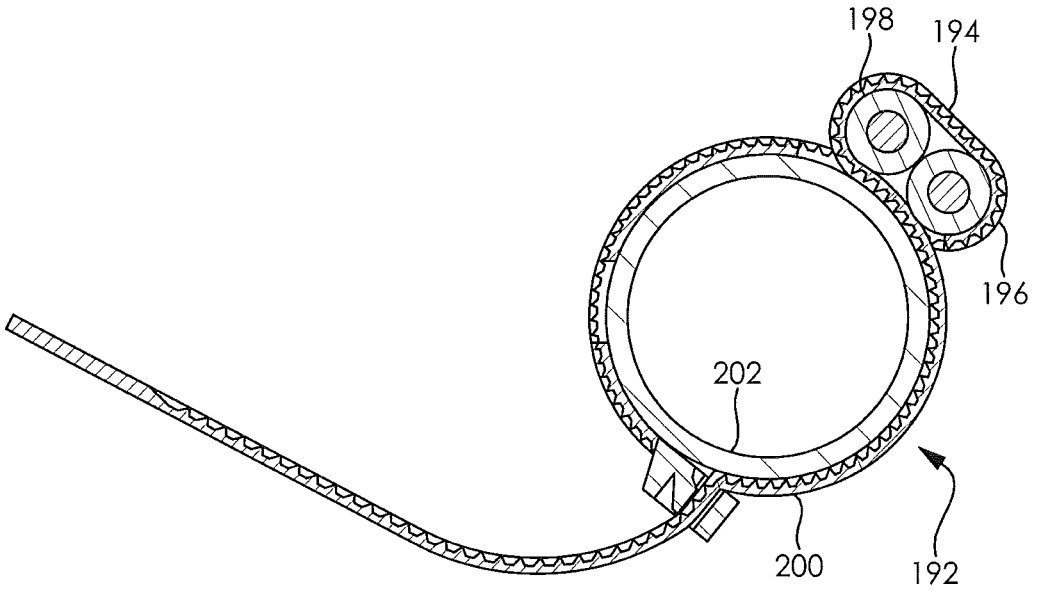
FIG. 25 is a cross sectional view showing three objects connected by a connector according to the invention.

In an assembly 192 shown in FIG. 25, one of the connectors described above has been put into service by forming a flexible strap 194 into a first loop 196 encircling first and second cables 198 and 200. A second loop 202 has been formed around a frame member 204. Each of the cables 198 and 200 are spaced from the frame 204 by a distance ranging from the thickness of the flexible strap 194 to twice the thickness of the flexible strap, depending on which of the connectors described above is selected.

Figure 26:
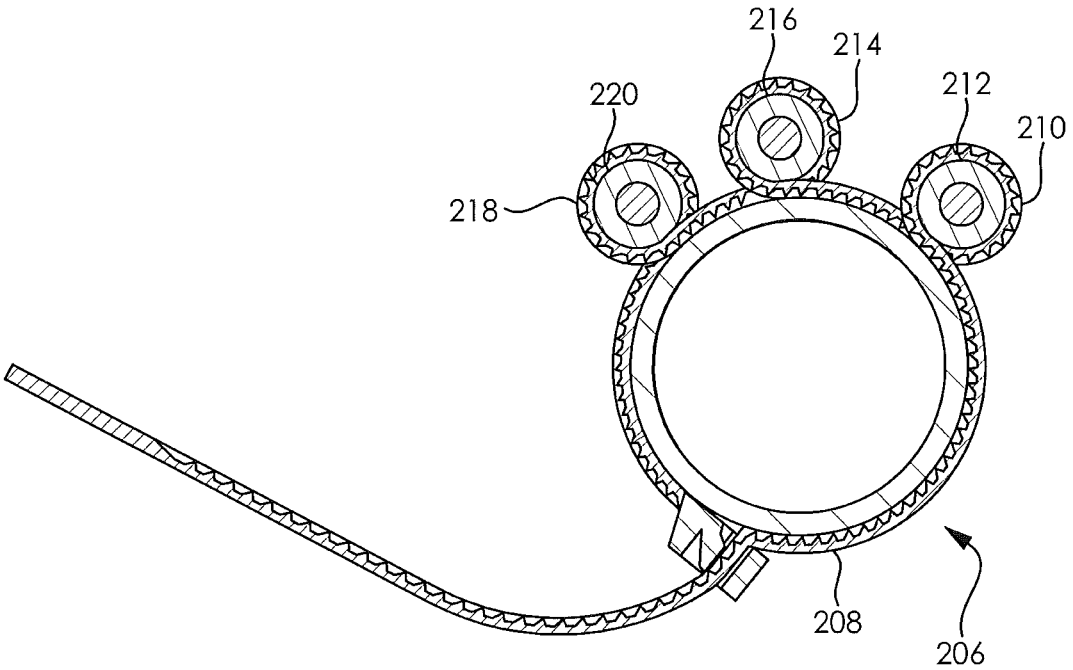
FIG. 26 is a cross sectional view showing four objects connected by a connector according to the invention.

In an assembly 206 shown in FIG. 26, one of the connectors described above has been put into service by forming a flexible strap 208 into a first loop 210 encircling a first cable 212, a second loop 214 encircling a second cable 216 and a third loop 218 encircling a third cable 220. In forming each of these three loops, a flexible strap of a connector has been wrapped around one of the cables and a flexible strap tongue has been inserted through a flexible strap non-locking slot until the three loops 210, 214 and 218 have been formed around the three cables 212, 216 and 220. It is to be noted that a smooth side of the connector strap is in contact with the outside of each of the three cables 212, 216 and 220. A fourth loop 222 has been formed around a frame member 224. In an assembly including one of the connectors 26, 84, 106, 124, 144 or 160 or a similar connector, each of the cables 212, 216 and 220 is spaced from the frame 224 by a distance equal to the thickness of the flexible strap of the connector. In the case of the connector 178, each of the cables 212, 216 and 220 would be spaced from the frame 224 by a distance equal to twice the thickness of the flexible strap 180.

Another example of a flexible connector according to the invention is indicated generally at 300 in FIGS. 27 through 32. The connector 300 comprises a flexible strap 302 with first and second ends 304 and 306, a first broad side 308 and a second broad side 310 FIG. 28, a first edge 312 and a second edge 314. On at least one of the broad sides, 308 and 310, adjacent to the end 304, there is one of a hook or loop fastener and, adjacent to the end 306, on at least one of the broad sides 308 and 310, there is a mating hook or loop fastener. A non-locking slot, indicated at 316, extends longitudinally along the strap 302 between the edges 312 and 314.

Figure 28:
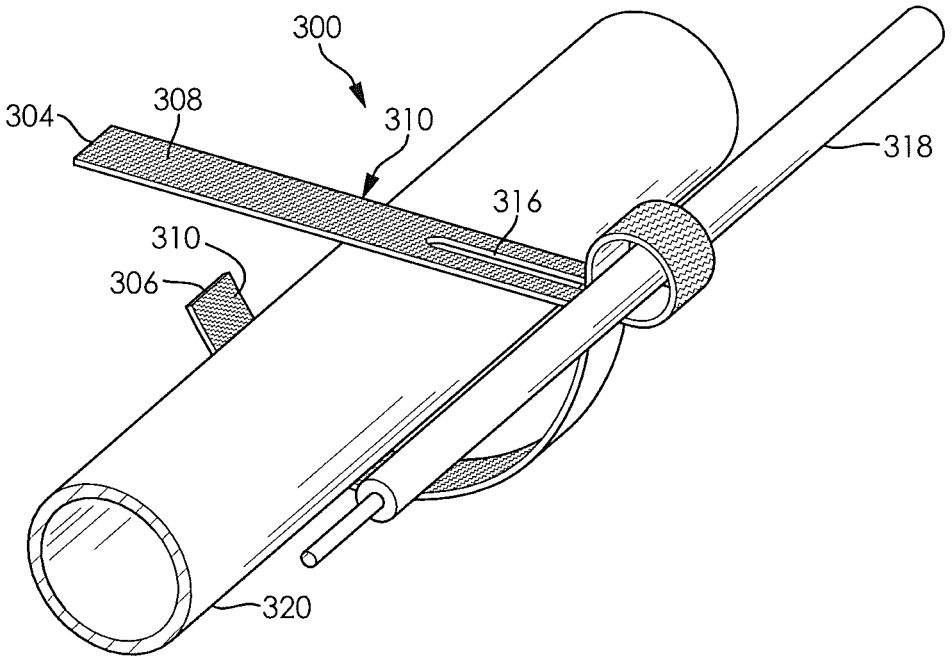
FIG. 28 is a perspective view showing a step in a method for using the connector to connect two objects.
Figure 29:
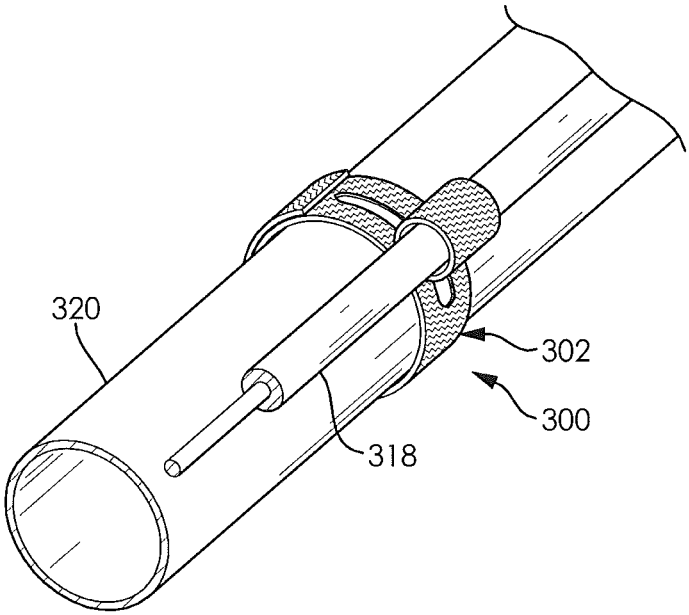
FIG. 29 is a perspective cross sectional view showing a step in a method for using the connector to connect two objects.
Figure 30:
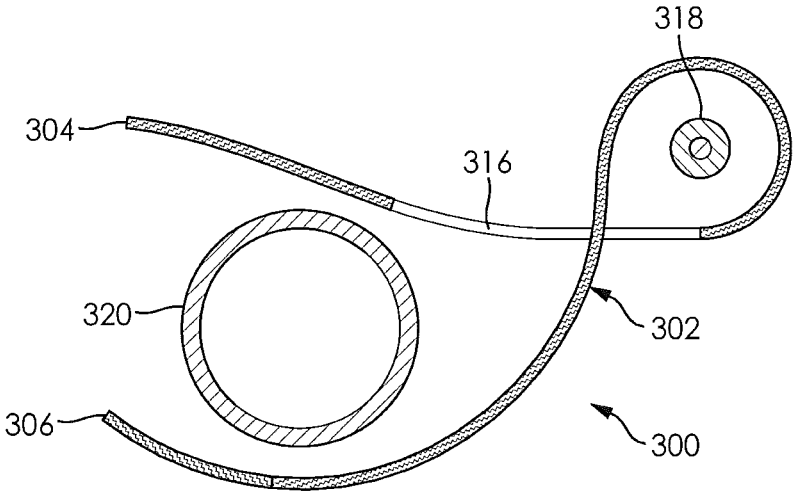
FIG. 30 is a cross sectional view showing a step in a method for using the connector to connect two objects.
Figure 31:
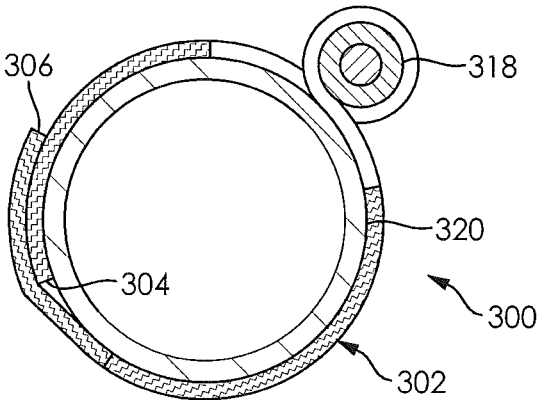
FIG. 31 is a cross sectional view showing two objects connected by the connector.
Figure 32:
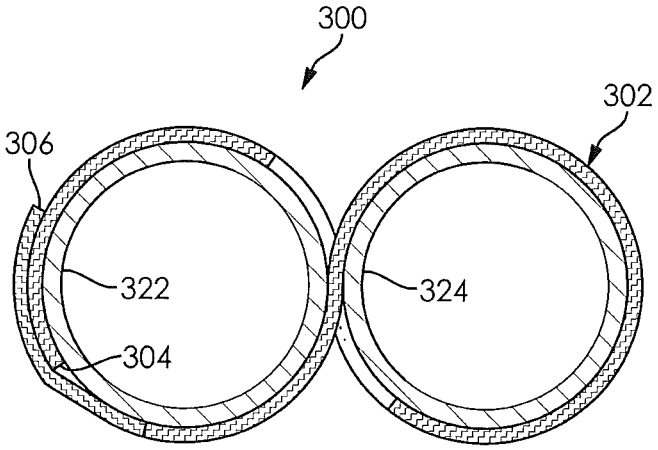
FIG. 32 is a cross sectional view showing two similarly sized objects connected by the connector.
Figure 33:
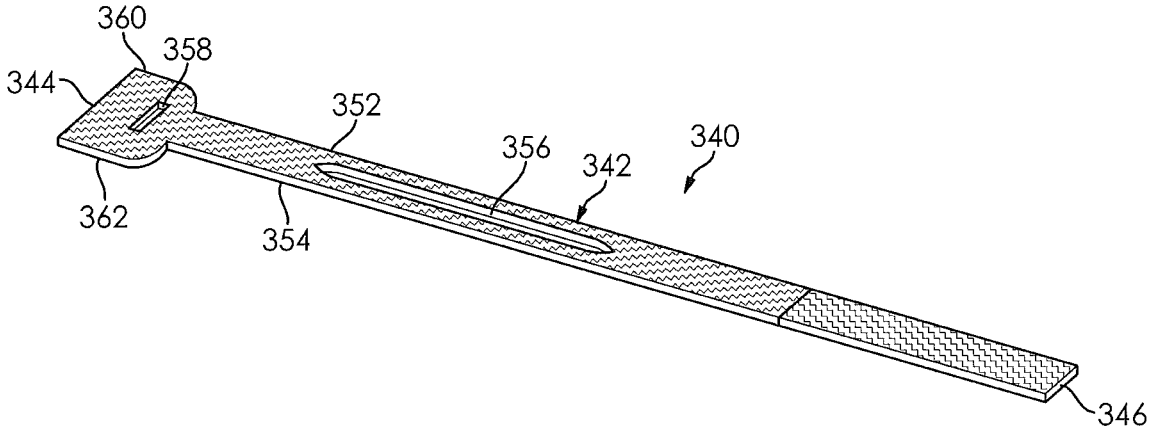
FIG. 33 is a perspective view of another example of a connector embodying the invention.

The strap 300 may be used to connect a first object 318 to a second object 320 as follows. The strap 300 is wrapped around the first object 318 forming a first loop. The second end 306 is inserted through the non-locking slot 316, as can be seen in FIGS. 28 and 30. The free ends 304 and 306 are then wrapped around the second object 320, in a FIG. 8 configuration, forming a second loop around the second object 320. The first end 304 is positioned adjacent to the second object 320 with the hook or loop faster adjacent to the first end 304 facing away from the second object 320. Tension is then applied to the second end 306 as it is wrapped around the second object 320 so that the first and second loops tighten around the first and second objects 318 and 320. The mating hook or loop fastener adjacent to the second end 306 is then pressed against the hook or loop fastener adjacent to the first end 304 so that the hook and loop fasteners engage while the first and second loops are tightly wrapped around the first and second objects 318 and 320, as shown in FIG. 31. Thus, the strap 300 connects the objects 318 and 320 and the connection is maintained by engagement of the hook and loop fasteners. It is a releasable connection because the hook and loop fasteners can be selectively disengaged. The first and second objects 318 and 320 have small and large diameters, respectively. In FIG. 32, the strap is shown connecting first and second objects 322 and 324 which have similar diameters. A strap 300 of a given length can be formed into two loops to connect objects of differing sizes. If desired, one or both of the ends 304 and 306 can be trimmed to give the connection a neat appearance.

Especially good results have been obtained in the case where the strap is made of a textile material. Different textile materials may be selected and the strap 300 may be tailor made for different applications. For example, the strength of the textile material may be selected to handle the expected stress of any given connection. The width of the strap 300 may also be varied as desire depending, for example, on the size and the weight of the objects it connects. The length of the strap 300 may pre-set for a given application or, as indicated above, the ends may be trimmed, as desired. The holding/shear strength of the hook and loop fasteners may be selected for a particular application so that, when engaged, they releasably lock the ends 304 and 306 against relative longitudinal movement. The length of the hook and loop fasteners may be set so that only one of them is adjacent to the objects connected by the strap and it may be desirable to set the length of the coarser hook fastener section so that it does not contact either the first or second object. As noted above, hook and loop fastener is intended to encompass all manner of fasteners which comprise a first and second material which, when pressed together, mechanically engage each other to releasably connect objects to which they, in turn, are connected.

Figure 34:
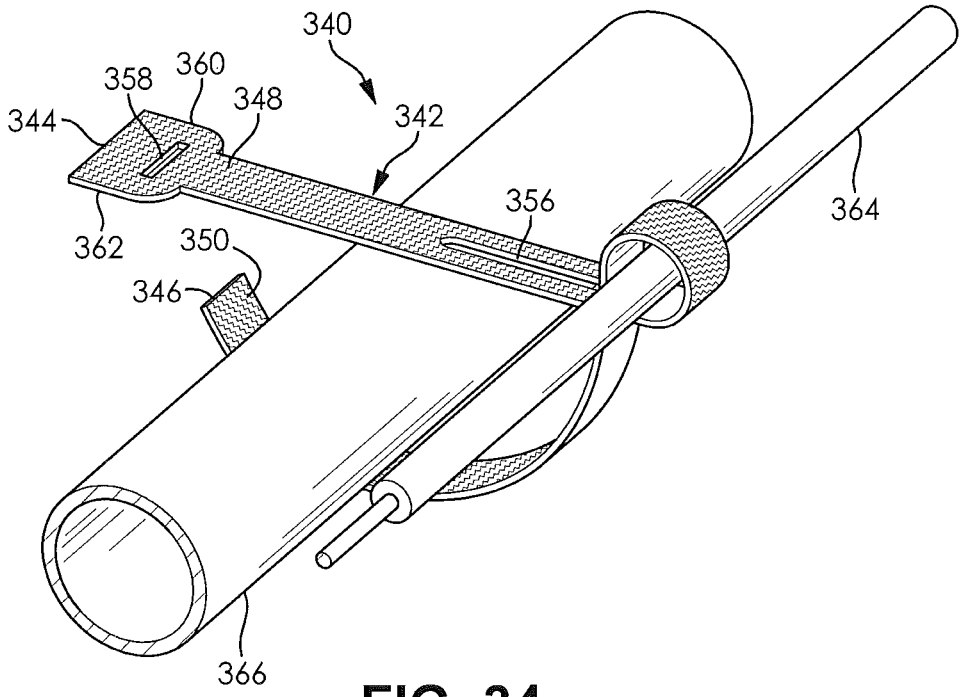
FIG. 34 is a perspective view showing a step in a method for using the connector to connect two objects.
Figure 35:
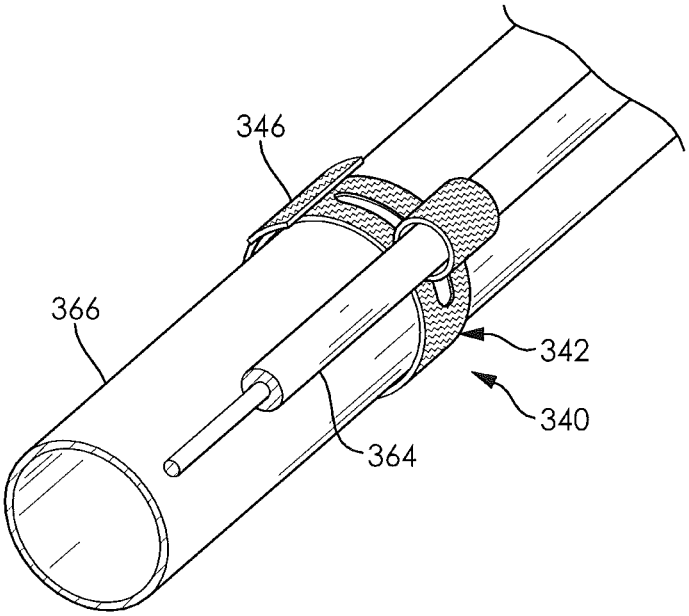
FIG. 35 is a perspective cross sectional view showing a step in a method for using the connector to connect two objects.

Another example of a connector according to the invention is indicated generally at 340 in FIGS. 33 through 46 and includes a tightening feature. The connector 340 corresponds, generally, with the connector 300, and comprises a flexible strap 342 with first and second ends 344 and 346, a first broad side 348 and a second broad side 350 as can be seen in FIG. 34, a first edge 352 and a second edge 354. On at least one of the broad sides, 348 and 350, adjacent to the end 344, there is one of a hook or loop fastener and, adjacent to the end 346, on at least one of the broad sides 348 and 350, there is a mating hook or loop fastener. A non-locking slot, indicated at 356, extends longitudinally along the strap 342 between the edges 352 and 354.

The connector 340 further comprises a tightening element comprising a lateral slot indicated at 358 and it is adjacent to the end 344. The length of the slot 358 corresponds, generally, with the distance between the first and second edges 352 and 354. Near the end 344 of the strap 342, and adjacent the slot 358, the width of the strap 342 is the distance between edges 360 and 362 and this distance is greater than the distance between edges 352 and 354.

Figure 36:
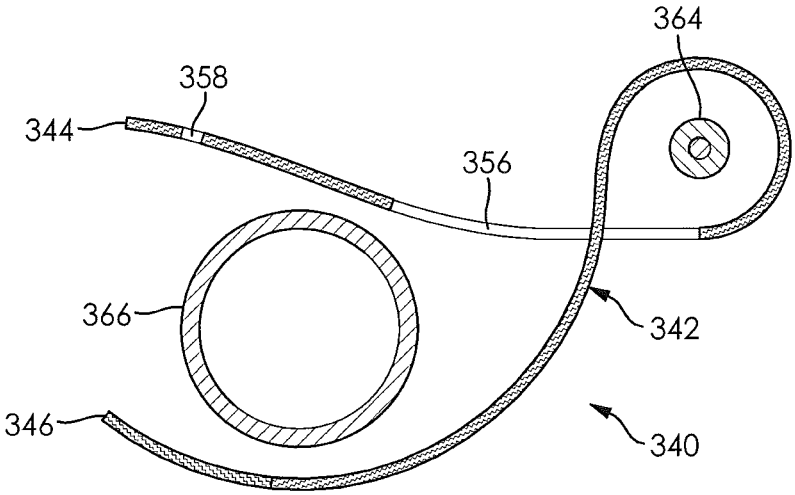
FIG. 36 is a cross sectional view showing a step in a method for using the connector to connect two objects.
Figure 37:
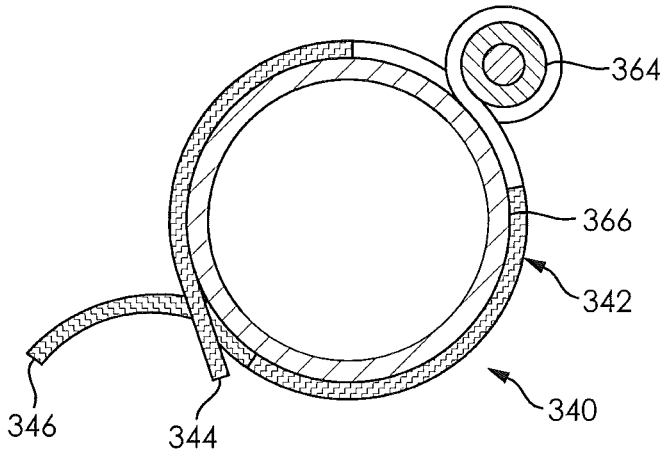
FIG. 37 is a cross sectional view showing a step in a method for using the connector to connect two objects.
Figure 39:
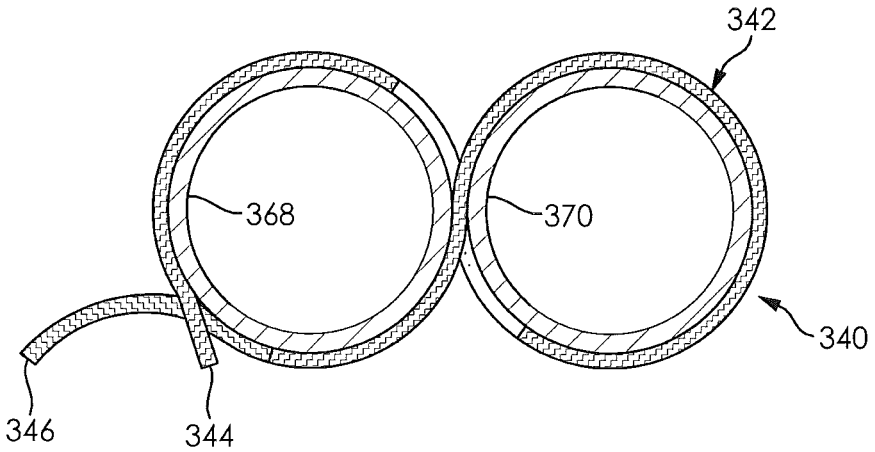
FIG. 39 is a cross sectional view showing a step in a method for using the connector to connect two objects.

The strap 340 may be used to connect a first object 364 to a second object 366 as follows. The strap 340 is wrapped around the first object 364 forming a first loop, as shown in FIGS. 34 and 36. The second end 346 is inserted through the non-locking slot 356, as can be seen in FIGS. 34 and 36. The free ends 344 and 346 are then wrapped around the second object 366, in a FIG. 8 configuration, forming a second loop around the second object 366. The second end 346 of the strap 342 is inserted through the tightening slot 358 from the inside (adjacent to the object 366) to the outside, leaving the second end 346 extending out and away from the first end 344 of the strap 342, as shown in FIGS. 37 and 39. By pulling the second end 346 towards the end 344, tension is applied to the strap 342 to tighten the loops.

Figure 38:
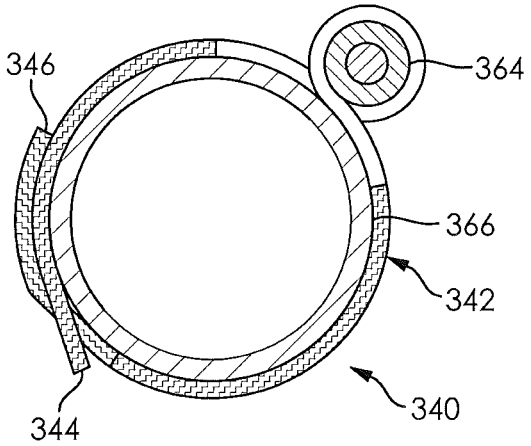
FIG. 38 is a cross sectional view showing two objects connected by the connector.
Figure 40:
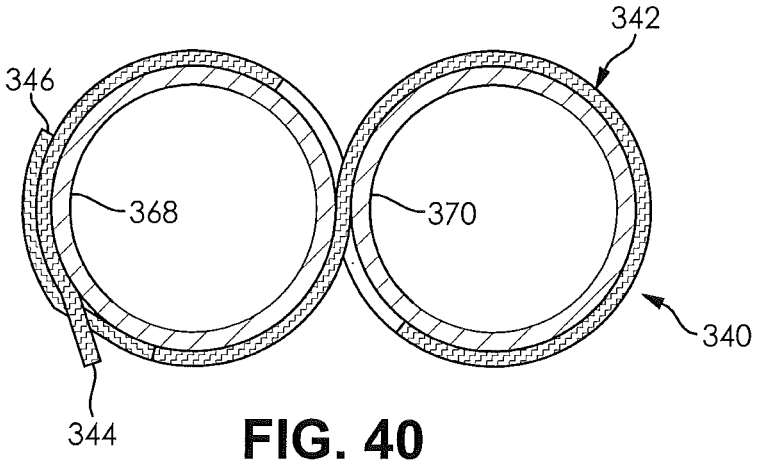
FIG. 40 is a cross sectional view showing two similarly sized objects connected by the connector.

A portion of the strap 342 adjacent to the first end 344 is positioned adjacent to the second object 366 with the hook or loop faster adjacent to the first end 344 facing away from the second object 366. The second end 346 of the strap 342 is then wrapped around the second object 366 while the first and second loops remain tight around the first and second objects 364 and 366. The mating hook or loop fastener adjacent to the second end 346 is then pressed against the hook or loop fastener adjacent to the first end 344 so that the hook and loop fasteners engage while the first and second loops are tightly wrapped around the first and second objects 364 and 366, as shown in FIG. 38. Thus, the strap 340 connects the objects 364 and 366 and the connection is maintained by engagement of the hook and loop fasteners. It is a releasable connection because the hook and loop fasteners can be selectively disengaged. The first and second objects 364 and 366 may have small and large diameters, respectively, as shown in FIG. 38. In FIG. 40, the connector 340 is shown connecting first and second objects 368 and 370 which have similar diameters, in the manner in which the objects 364 and 366 are connected in FIG. 38. In FIG. 42, the connector 340 is shown connecting first and second objects 368 and 370 which have similar diameters, in the manner in which the objects 364 and 366 are connected in FIG. 41. In the connections shown in FIGS. 40 and 42, it is preferred that the strap 342 be tensioned, as described above, and illustrated in FIG. 39.

Figure 43:
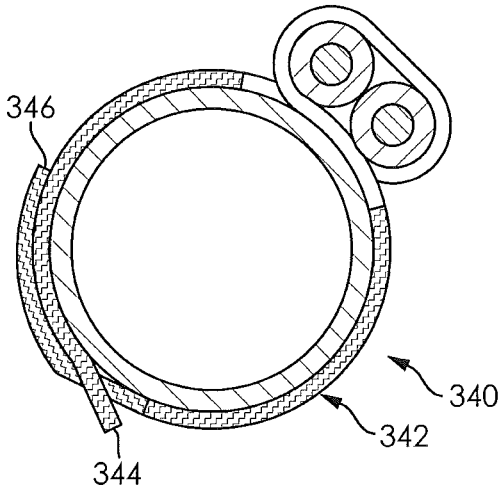
FIG. 43 is a cross sectional view showing three objects connected by a connector according to the invention.
Figure 45:
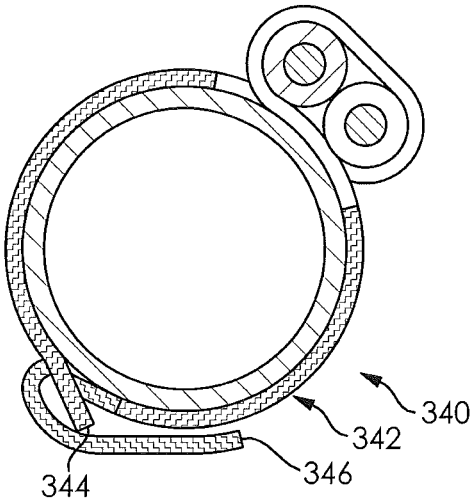
FIG. 45 is a cross sectional view showing three objects connected by a connector according to the invention.

In the manner in which the objects 364 and 366 are connected to each other by the connector 340, as shown in FIGS. 37 and 38, three objects may be connected by the connector 340, as shown in FIG. 43. In the manner in which the objects 364 and 366 are connected to each other by the connector 340, as shown in FIGS. 37 and 41, three objects may be connected by the connector 340, as shown in FIG. 45.

Figure 41:
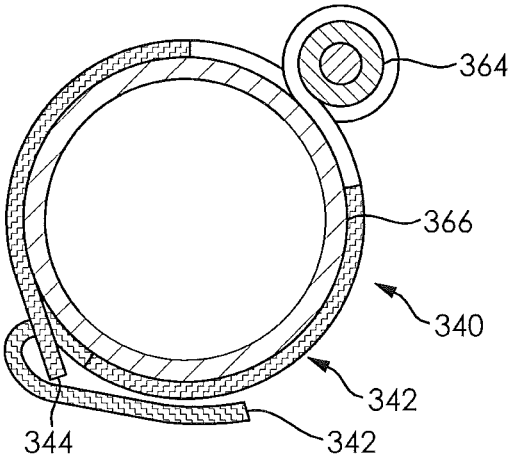
FIG. 41 is a cross sectional view showing two objects connected by the connector.
Figure 42:
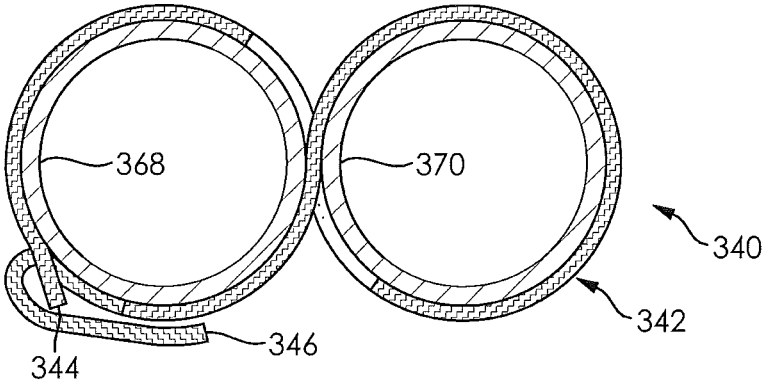
FIG. 42 is a cross sectional view showing two similarly sized objects connected by the connector.
Figure 44:
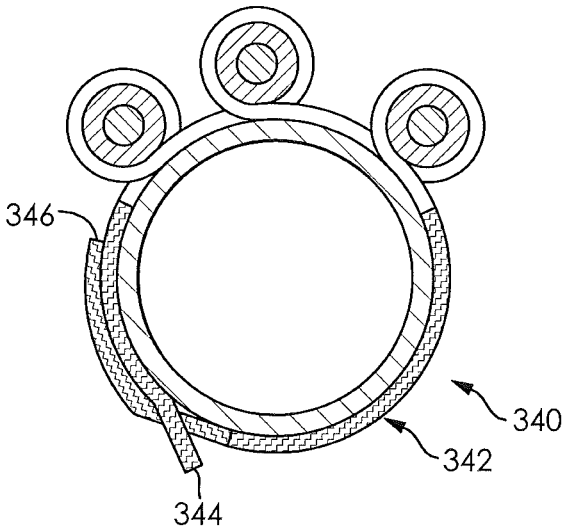
FIG. 44 is a cross sectional view showing four objects connected by a connector according to the invention.
Figure 46:
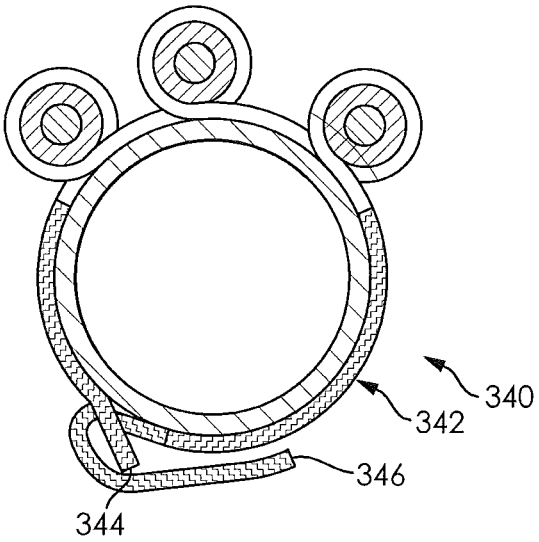
FIG. 46 is a cross sectional view showing four objects connected by a connector according to the invention.

In the manner in which the objects 364 and 366 are connected to each other by the connector 340, as shown in FIGS. 37 and 41, four objects may be connected by the connector 340, as shown in FIG. 46. In the manner in which the objects 364 and 366 are connected to each other by the connector 340, as shown in FIGS. 37 and 38, four objects may be connected by the connector 340, as shown in FIG. 44.

Figure 47:
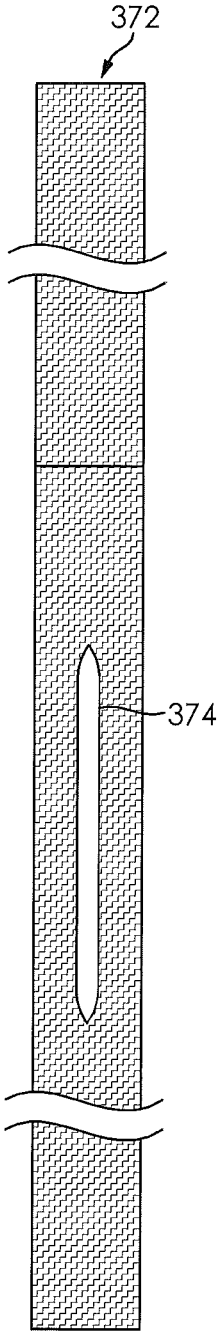
FIG. 47 is a plan view of an example of a slot in a connector according to the invention.
Figure 48:
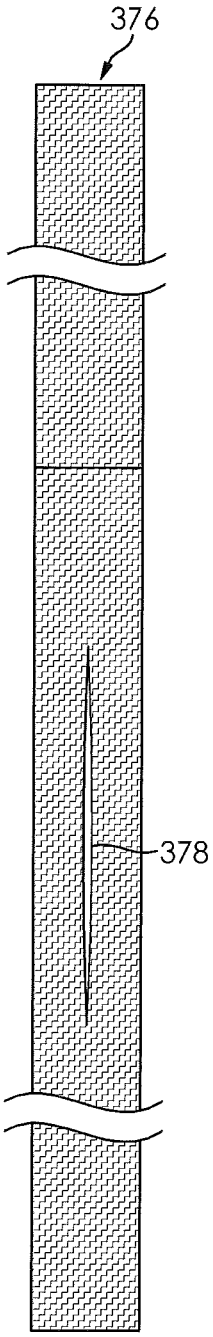
FIG. 48 is a plan view of another example of a slot in a connector according to the invention.
Figure 49:
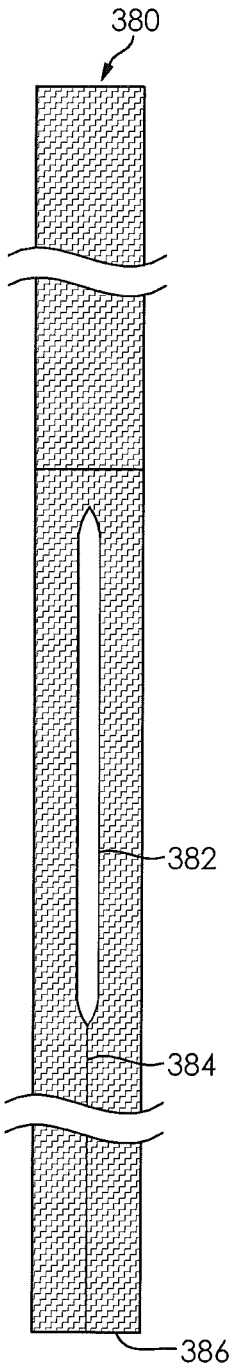
FIG. 49 is a plan view of another example of a slot in a connector according to the invention.

A few of the many strap variations encompassed in the present invention are shown in FIGS. 47 through 49. Specifically, a strap 372 may have a non-locking slot 374 that is a cut out, as shown in FIG. 47. A strap 376 may have a non-locking slot 378 that is formed by a simple single cut, as shown in FIG. 48. A strap 380 may have a non-locking slot, a portion of which is cut out, as indicated at 382, and a second portion of which is formed by a simple single cut, as indicated at 384 in FIG. 49. The simple single cut 384, in this case, extends from the cut out slot 382 to an end 386 of the strap. These are but three examples of configurations for a non-locking slot that may be used in a flexible connector according to the present invention.

Figure 1:
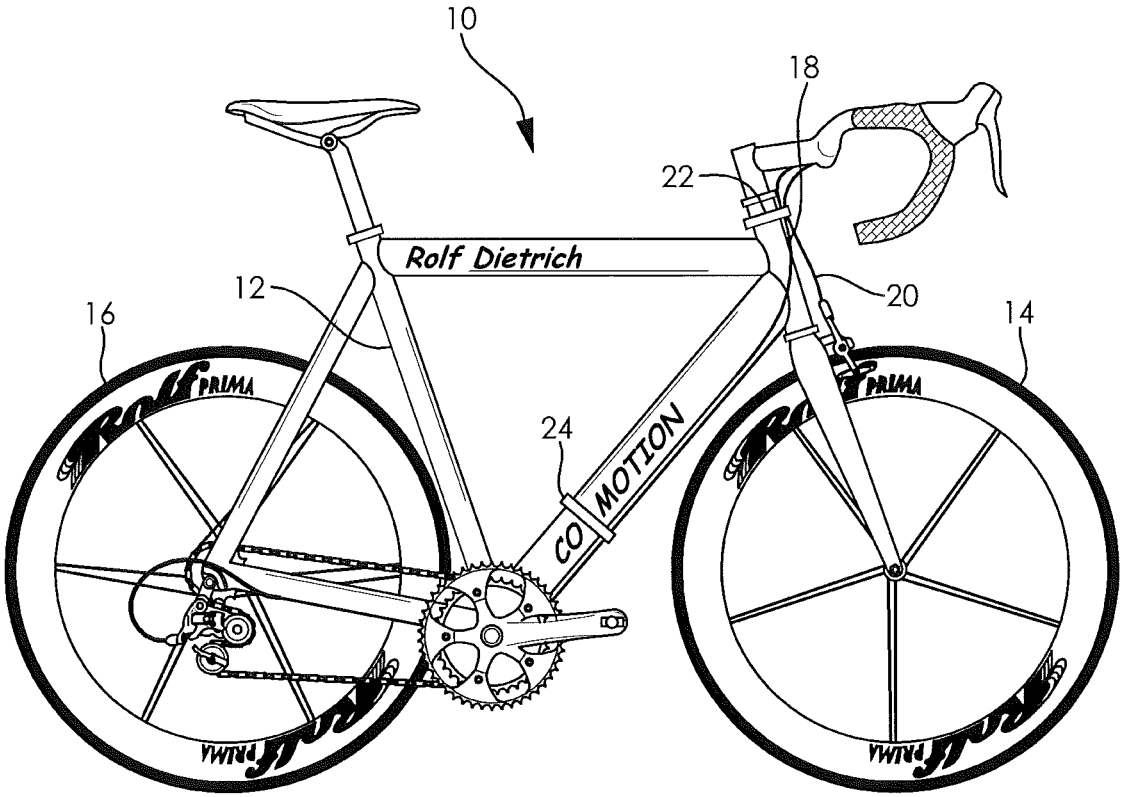
FIG. 1 is a view showing a bicycle having a cable connected to a bicycle frame by a connector according to the invention.
Figure 2:
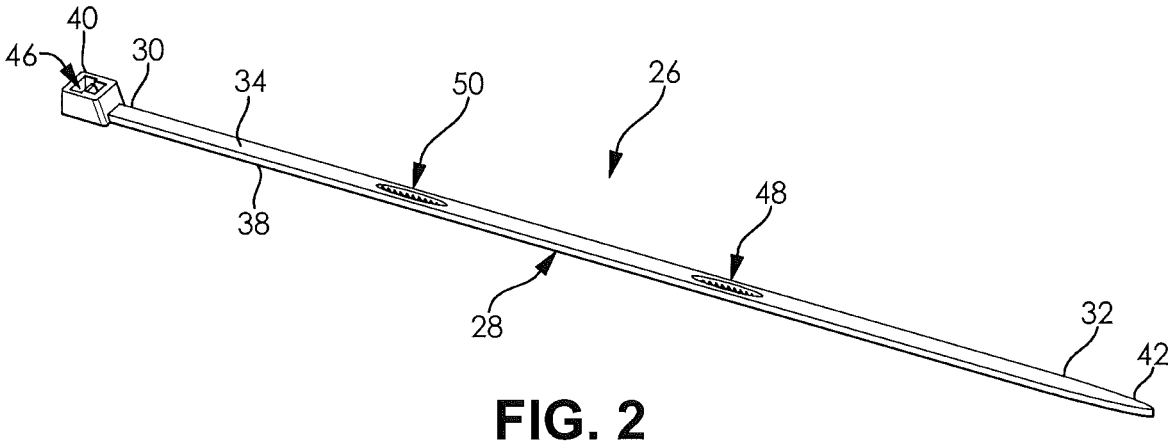
FIG. 2 is a perspective view of a first example of a connector embodying the invention.

It will be evident from the drawing figures that some of the physical and/or spatial relationships recited in the description of various portions of a connector according to the invention refer to cases where the connector is tightened such as in FIGS. 9, 10, 25, and 26 and other relationships refer to cases where the connector is in a relaxed state such as in FIG. 2. Furthermore, it will be apparent to a person of ordinary skill in the art that flexible connectors according to the present invention may be embodied that differ from the examples shown and described herein, without departing from the spirit and scope of the invention as defined in the following claims.

I claim:

1. A connector comprising a flexible strap having a first end, a second end and a first broad side extending therebetween, said first broad side having a first edge extending from the first end to the second end in an uninterrupted linear form and an opposing second edge extending from the first end to the second end in an uninterrupted linear form, said flexible strap extending longitudinally in between said first end and said second end, a first fastener adjacent to said first end of said strap, said first fastener comprising a hook or loop fastener on said strap, a second fastener adjacent to said second end of said strap, said second fastener comprising a mating hook or loop fastener on said strap, and a non-locking slot in said strap, said non-locking slot extending longitudinally from a point near said first end of said strap towards said second end of said strap, said slot defined longitudinally by opposing sides, said opposing sides having an uninterrupted parallel orientation, said slot configured to receive said second end of said strap therethrough such that a first loop is formed around a first article, wherein said first broad side faces said first article, said slot having a width that is less than a width of a portion of the strap retained in the slot with the strap in a wrapped arrangement around the first article, a non-locking transverse slot adjacent to said first end of said strap;

wherein said non-locking slot permits movement of said strap in two directions when received therein, and wherein said first and second fasteners are operable, when engaged, to prevent movement between said first end and said second end.

2. The connector claimed in claim 1 wherein said strap is made from a fabric material.

3. The connector claimed in claim 1 wherein said first fastener comprises a hook or loop fastener on said first side of said strap, and said second fastener comprises a mating hook or loop fastener on said second side of said strap.

4. The connector claimed in claim 1, wherein the connector is configured to form a first loop around a first article and a second loop around a second article.

5. The connector claimed in claim 4, wherein said second loop around said second article includes a second broad side that faces said second article.

6. The connector claimed in claim 1, wherein the connector is configured to form a first loop around a first article and additional loops around additional articles.

7. The connector claimed in claim 1, wherein said slot has the form of a cutout.

8. The connector claimed in claim 1, wherein said slot has the form of a single cut.

* * * * *